US005556593A

United States Patent [19]

Grenier

[11] Patent Number: 5,556,593

[45] Date of Patent: Sep. 17, 1996

[54] METHOD AND APPARATUS FOR HEAT TREATING METAL PARTS

[76] Inventor: Mario Grenier, 1324 de la Montagne, St. Nicolas, Quebec, Canada, G0S 2Z0

[21] Appl. No.: 358,580

[22] Filed: Dec. 14, 1995

[30] Foreign Application Priority Data

Dec. 14, 1993 [GB] United Kingdom ..... 9325571

[51] Int. Cl.[6] ..... C21D 1/06

[52] U.S. Cl. ..... 266/257; 266/250

[58] Field of Search ..... 266/249, 252, 266/257, 250; 432/137, 138, 145, 144, 143; 148/601, 657

[56] References Cited

U.S. PATENT DOCUMENTS

| | | | |
|---|---|---|---|
| 3,163,694 | 12/1964 | Ipsen | 266/252 |
| 4,332,551 | 6/1982 | Haslmayr et al. | 432/137 |
| 4,807,853 | 2/1989 | Murakami et al. | 266/252 |
| 4,881,987 | 11/1989 | Kanbara et al. | 148/601 |

FOREIGN PATENT DOCUMENTS

| | | |
|---|---|---|
| 0473784 | 12/1990 | Canada . |
| 2032652 | 12/1990 | Canada . |

*Primary Examiner*—Scott Kastler

*Attorney, Agent, or Firm*—Birch, Stewart, Kolasch & Birch, LLP

[57] ABSTRACT

A heat insulated enclosure with an inlet introducing metal parts such as coil springs to be heat treated, such as by annealing. The apparatus also includes a support on which the metal parts are received, where they are continuously moved towards an outlet. A continuous flow of hot air is circulated substantially perpendicularly with respect to the metal parts to provide the heat treatment. This can be achieved by means of a rotary disk to receive the metal parts and allowing them to follow a spiral path until reaching the outlet. This system enables a continuous operation and is therefor much cheaper to operate.

13 Claims, 3 Drawing Sheets

METHOD AND APPARATUS FOR HEAT TREATING METAL PARTS

BACKGROUND OF THE INVENTION

1. Field of the Invention

The invention relates to an apparatus for heat treating metal parts. More particularly, the present invention relates to the field of heat treating apparatuses and is particularly concerned with a device for carrying out the stress relief of coil springs by moving high velocity heated gases therethrough. The present invention could also be used to carry other heat treatments, such as annealing, hardening or the like, of a variety of other metal parts.

2. Description of Prior Art

A number of documents disclose circular heat treating apparatuses of various configurations using heated gases emanating from a turbine and being discharged through a load in order to heat it.

Canadian Patent No. 473,784 discloses a furnace for annealing coils of steel strips. According to this reference, the coils are stacked vertically On a support provided in a furnace, and a fan and heating devices are provided to create a flow of hot air through the coils. After heat treatment, the heat treated coils are removed from the furnace and the operation is repeated with an additional supply of coils.

Canadian Application No. 2,032,652 is particularly concerned with a furnace susceptible of universal application which includes a sophisticated arrangement capable of providing a wind mass annulus in the furnace.

To our knowledge, there is no furnace capable providing a heat treatment of metal parts in a continuous manner, which is simultaneously inexpensive and efficient. In other Words, these devices of the batch type do not provide for continuous movement of the parts through them.

SUMMARY OF INVENTION

It is an object of the present invention to provide heat treating apparatus which is capable of continuous operation in heat treating metal parts, especially in the annealing of metal parts such as metallic coils.

It is another object of the invention to provide a continuous device which will allow the user to carry the stress relief operation in line with other coil spring manufacturing operations.

It is another object of the present invention to provide a machine for heat treating metal parts, with a circular shape and laminar air flow thereby ensuring, utmost temperature uniformity and treatment precision.

It is another object of the present invention to provide a furnace which takes up one third of the floor space as compared to other belt furnaces, and requires 30 percent less energy.

These and other objects of the present invention may be achieved by providing an apparatus for heat treating metal parts, which comprises, a heat insulated enclosure, having an inlet port for introducing metal parts therein, and an outlet port for removing heat treated metal parts therefrom, means mounted in the enclosure to support metal parts introduced therein through the inlet port and to continuously move same towards the outlet port, where they are removed from the enclosure, means for providing a continuous flow of heated air capable of heat treating the metal parts by crossing the metal parts, and means causing the flow of heated air to cross the metal parts substantially at right angle thereto as the latter are being moved on the support means.

Preferably, the heat insulated enclosure consists of a hollow cylindrical member defined by a circumferential wall, a bottom wall and a removable cover.

According to a preferred embodiment of the invention, the inlet port comprises an opening formed in the removable cover and generally aligned with an area of the support means intended to receive the metal parts to be heat treated. On the other hand, the outlet port may comprise a chute provided in the circumferential wall and located at a level corresponding to that of the support means.

According to another preferred embodiments, the support means comprises a rotatable disk mounted in the enclosure, and means operatively connected to the disk to cause rotation thereof. For example, the rotation means may comprise a variable speed motor.

According to yet another preferred embodiment there is provided a turntable in the lower part of the hollow cylindrical member, and means for spacedly mounting the disk above the turntable.

According to another preferred embodiment, the bottom wall is formed with a central aperture, and a sleeve extends through the central aperture and is connected to the turntable at one end thereof and to the variable speed motor at the other end.

According to another preferred embodiment, the means for spacedly mounting the disk over the turntable comprises a plurality of aerodynamic fins connecting the disk to the turntable and arranged to allow the flow of heated air to circulate therethrough.

The apparatus according to the invention may also comprise a centrifugal fan disposed between the disk and the turntable, and means operatively connected to the centrifugal fan to provide a flow of air in the enclosure. Preferably, the centrifugal fan is connected to a second motor by means of a shaft, the shaft extending through the sleeve.

The apparatus according to the invention may also comprise a plurality of heating elements distributed along the outer wall of the cylindrical member on the path of the air flow.

In accordance with another preferred embodiment, the centrifugal fan is constructed to direct the flow of air toward the circumferential wall, a first air diffuser is mounted in the enclosure on the path of the air flow to orient it substantially perpendicularly relative to the metal parts.

The apparatus may also comprise a second air diffuser mounted over the disk and constructed to redirect the air flow towards the centrifugal fan by passing through a central circular gap provided in the disk, thereby ensuring a continuous circulation thereof.

In accordance with another preferred embodiment, the apparatus according to the invention may also comprise a vertical guide which is fixed to the second air diffuser and to the circumferential wall which is mounted to slide relative to the surface of the disk as the latter rotates, the guide defining a spiral path.

According to yet another preferred embodiment the second air diffuser is mounted over the disk to cover the central circular gap, the opening in the cover is offset with respect to the central opening, the spiral path extending away from the central gap to reach the chute, the cover opening being aligned with the start of the spiral path. Preferably, the spiral path is shaped to enclose metal coils such as coil springs and to direct them towards the chute upon rotation the disk.

According to the invention there is provided a method of heat treating metal parts which comprises introducing metal parts to be annealed into a heat insulated enclosure containing a support for receiving the metal parts, continuously moving the metal parts on the support from a location wherein the same are received thereon, toward an outlet formed in the heat insulated enclosure, while the metal parts are being so moved, continuously directing a flow of heated air substantially at right angles with respect to the metal parts, recirculating the flow of heated air and removing the heat treated metal part from the heat insulated enclosure.

The support preferably comprises a disk, the metal parts are preferably moved on the disk along a spiral guide ending in the outlet.

BRIEF DESCRIPTION OF THE DRAWINGS

This invention is illustrated by means of the annexed drawings but is not restricted thereto. In the drawings which illustrate an embodiment of the invention.

DESCRIPTION OF PREFERRED EMBODIMENT

Figure 1:
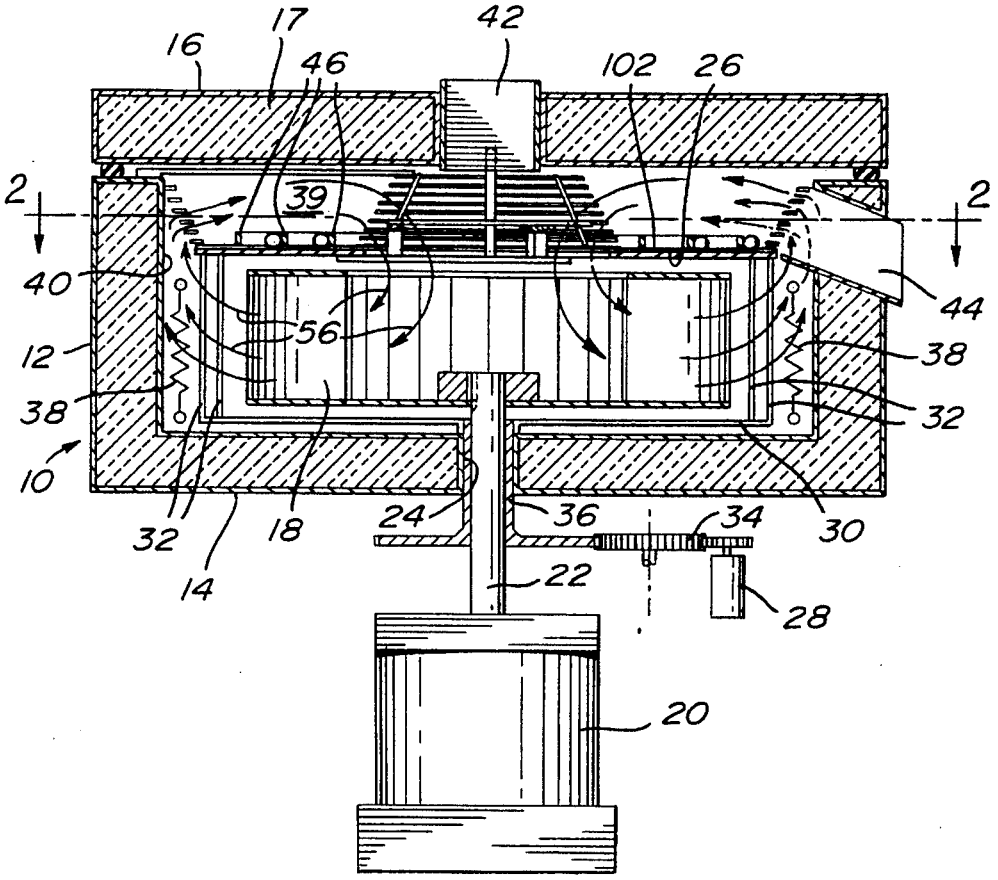
FIG. 1 is a longitudinal cross-section view taken along line 1—1 of FIG. 2 of an annealing device in accordance with an embodiment of the invention.

Referring to FIG. 1, there is shown a longitudinal cross-section view of an annealing device in accordance with an embodiment of the present invention. The annealing device comprises a thermally insulated hollow cylindrical body 10 defined by a circumferential wall 12, a bottom wall 14 and a removable cover 16. The cylindrical body 10 is made of a metallic double partition having an insulating material 17 therein.

The cylindrical body 10 is constructed and arranged to protectively enclose a centrifugal type of fan 18 which is rotatably coupled to a conventional power source such as a turbine driving motor 20. Fan 18 is linked to motor 20 through shaft 22 which extends through an aperture 24 provided in bottom wall 14.

The insulated cylindrical body 10 is also adapted to protectively enclose a disk 26 which is mechanically coupled to a variable speed disk motor 28. Disk 26 is spacedly mounted over a rotation turntable 30 by means of a plurality of substantially vertical aerodynamic fins 32. Turntable 30 is linked to a gear mechanism 34 by means of a sleeve 36.

Shaft 22 extends through sleeve 36 and thereby also passes through aperture 24 provided in bottom wall 14 of the cylindrical body as mentioned above. Fan 18 and disk 26 are thus adapted to rotate independently of one another.

A plurality (usually 9 to 12, although this number may vary to a great length depending on the size of the annealing device and the amount of heat required) of heating elements in the form of heating coils 38 or the like are positioned circumferentially around the inner chamber defined by the cylindrical body 10 between the aerodynamic fins 32 and inner surface 40 of the circumferential wall 12.

An entry port 42, in the form of an aperture which extends through cover 16 is provided to allow for the insertion of the coil springs about to be heat treated to give it an annealing treatment. An outlet port 44 in the form of a chute, which extends through the peripheral side walls 12, is provided to allow the coils, once heat treated, to exit from the annealing chamber 39.

A fixed guide in the form of a spiral wall 46 slides relative to the upper surface of the disk 26. The spiral wall 46 is fixed, as indicated above, while the disk is allowed to rotate also as mentioned above by being operated through motor 28.

Figure 3:
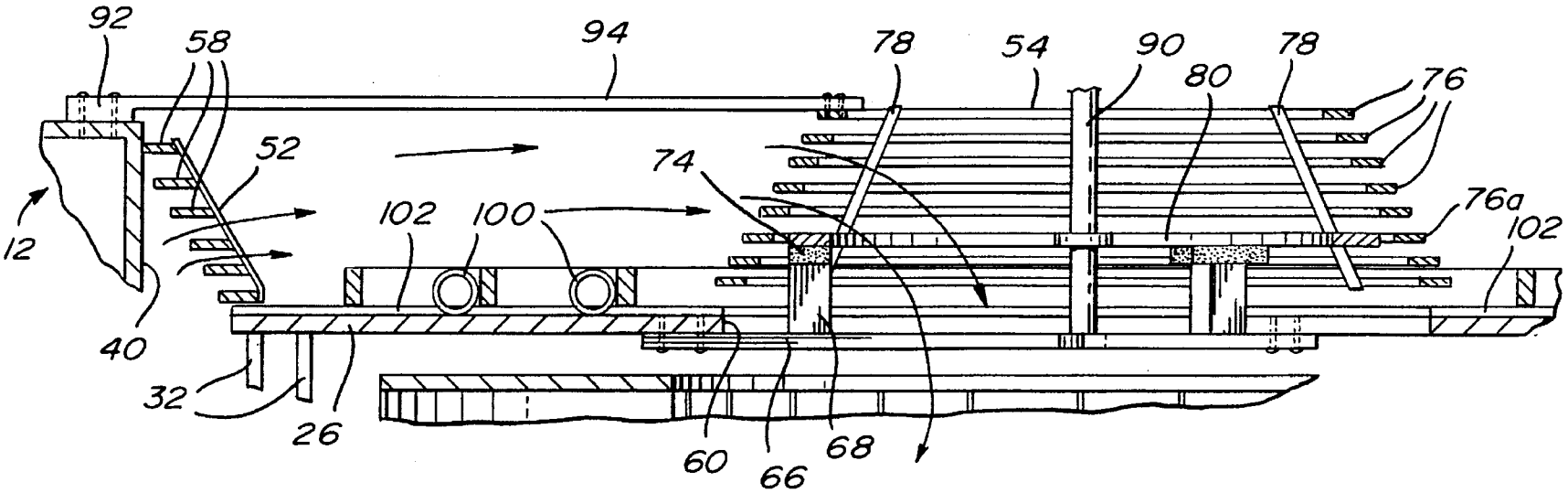
FIG. 3 is an enlarged cross-section view showing details of the two air diffusers and the mounting of the central air diffuser above the disk.

For more details, reference will now be made to FIG. 3, where it will be seen that the annealing device also comprises an inlet air diffusing element 52 as well as an outlet air diffusing element 54. In order for the annealing device to operate properly, it is necessary that the air diffusing elements 52 and 54 as well as the spiral walt 46 be fixed relative to the rotatable disk 26. For this purpose inlet air diffusing element 52 which includes a plurality of blades 58 and is provided all around the circumferential wall 12 in the upper part thereof, is fixed by any means known to those skilled in the art against the inner surface 40 of the circumferential wall.

Figure 2:
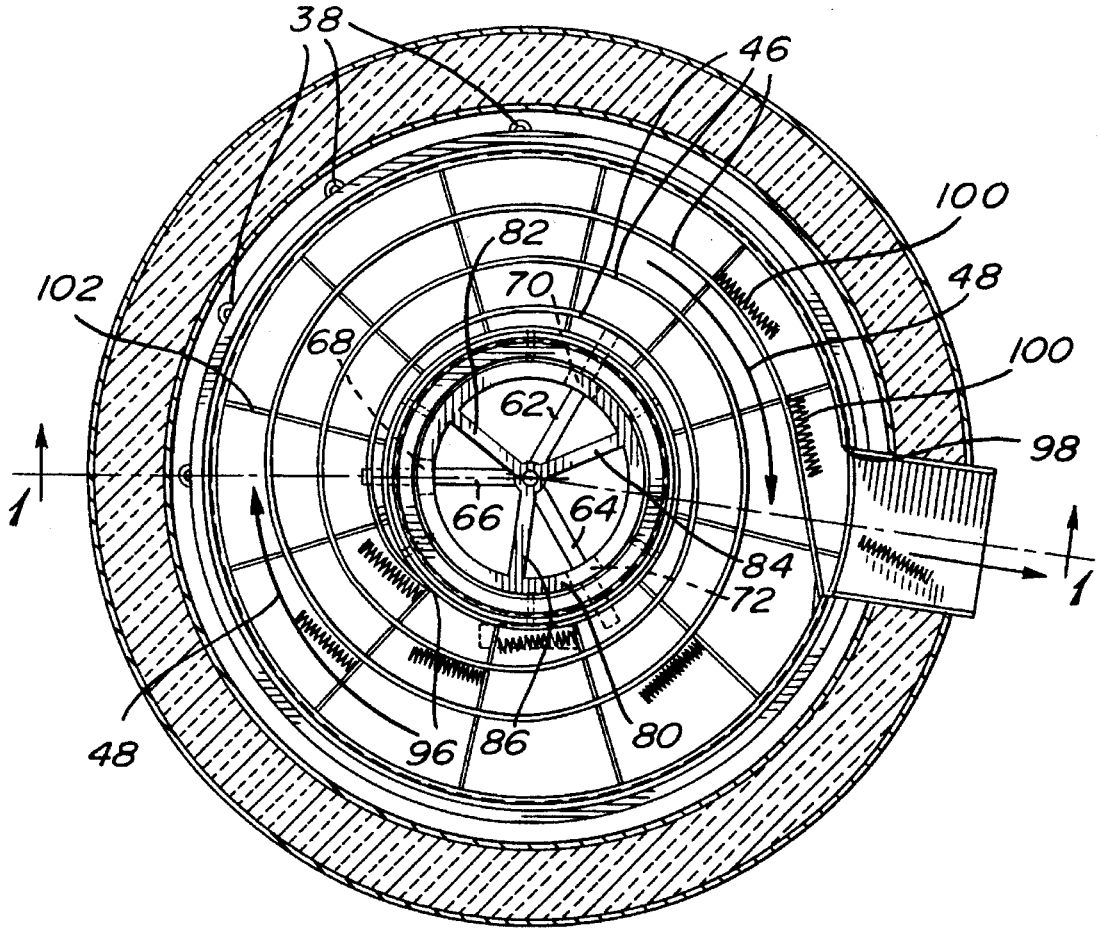
FIG. 2 is a transverse cross-section view taken along line 2—2 of FIG. 1 of the annealing device illustrated in FIG. 1.

Turning now to the outlet air diffusing element 54 and the spiral wall 46, reference will again be made to FIG. 3. It should first be mentioned that disk 26 is formed with a central gap 60 which enables air to be recirculated to the centrifugal fan 18, as will be explained more in detail later. Three connecting arms 62, 64, 66 (FIG. 2) are fixed at one end, by any known means, to the underface of disk 26 bordering gap 60 and are joined together at their other respective ends to coincide with the geometrical center of central gap 60. Three small posts 68, 70, 72 respectively covered with graphite pads 74, are fixedly mounted on the three posts 68, 70, 72 to upwardly project therefrom.

Returning to the outlet air diffusion element 54 it will first be realized that it mainly consists of a stacking of spacedly arranged circular blades 76 which are held together by means of slanted braces 78. In the lower part of the outlet diffusing element a circular band 80 is fixed in known manner to one of the blades, here blade 76*a*. Circular band 80 has three connecting radii 82, 84, 86 joined at their inner ends in coincidence with the joining of the three arms 62, 64, 66. A shaft 90 fixed to the three arms 62, 64, 66 extends Upwardly through the diffusion element 54 and passes through the function of the three radii 82, 84, 86 to freely rotate therethrough. This is merely intended to align the diffusing element when mounting the apparatus.

The diffusing element 52 is fixed to the cylindrical body 12 at 92 by means of an attachment 94. With respect to the spiral wall 56 it is fixed to the diffusing element 54 at 96 and to the cylindrical body at 98. It will also be seen that circular band 80 rests on the three graphite pads 74 which enables the disk 26 and the posts 68, 70, 72 to rotate relative to the air diffusing element 54 as a result of the slicing of the three graphite pads against the underface of the band 80.

In use, the coil springs 100 which are about to be heat treated are introduced through aperture 42 provided in cover 16 and are dropped onto disk 26. They are frictionally held on the disk 26 because of the nature of the material constituting the disk, and are guided by the spiral wall 46 through a substantially spiral pattern illustrated more specifically in FIG. 2 by arrows 48. Preferably, radial ribs 102 are provided on the surface of the disk to push the coils along the spiral path.

The coils thus remain on the disk 26 for a predetermined number of disk revolutions which can vary by modifying the spiral guide 46 and increasing or decreasing the number of spirals of the guide 46 depending on the part size and shape.

Typically, guide 46 will form two to five spirals. At the end of the last spiral, the coil which has been heat treated will exit the heating chamber 39 through the outlet port 44 as illustrated by arrow 48.

During the heat treatment, gases such as air are circulated by fan 18 which pushes the air radially through the fins 32. The latter guide the air through the radially disposed heating elements 38 thus heating it. The heated air is then pushed upwardly through space 50 provided between the inner surface of wall 12 and the fins 32. The air then passes through an inlet air diffusing element 52 and is thereby directed towards the metal coils 100 to be heat treated, substantially perpendicular thereto. When reaching the coils, heated air provides a heat treatment, the nature of which is predetermined by a skilled operator, and passes through them while carrying out the required treatment.

Once the air has reached the innermost spiral, it then passes through outlet diffusing element 54, which forms a single assembly unit with spiral guide 46, before being sucked in and axially re-entering the centrifugal type fan 18 in a continuous flow pattern. The air flow pattern is schematically illustrated by arrows 56.

It is understood that many modifications may be brought about to the preferred embodiment just described, without departing from the spirit and scope of the present invention. Also, even though the invention has been described with reference to the annealing of metal coils, it is understood that it may be applied to other heat treatments of other metal parts.

I claim:

1. Apparatus for heat treating metal parts comprising:

a heat insulated enclosure including a hollow cylindrical member defined by a circumferential wall, a bottom wall and a removable cover;

said enclosure having an inlet port for introducing metal parts therein, and an outlet port for removing heat treated metal parts therefrom;

means mounted in said enclosure to support metal parts introduced therein through said inlet port and to continuously move same towards said outlet, where they are removed from said enclosure;

said inlet port comprising an opening formed in said removable cover and generally aligned with an area of said support means intended to receive said metal parts to be heat treated;

said outlet port comprising a chute provided in said circumferential wall and located at a level corresponding to that of said support means;

said support means comprising a rotatable disk mounted in said enclosure, and means operatively connected to said disk to cause rotation thereof;

means for providing a continuous flow of heated air capable of heat treating said metal parts by crossing said metal parts; and means causing said flow of heated air to cross said metal parts substantially at right angle thereto as the latter are being moved on said support means.

2. Apparatus according to claim 1, wherein said rotation means comprise a variable speed first motor.

3. Apparatus according to claim 2, which comprises a turntable in the lower part of said hollow cylindrical member, and means for spacedly mounting said disk above said turntable.

4. Apparatus according to claim 3, wherein said bottom Wall is formed with a central aperture, a sleeve extending through said central aperture and connected to said turntable at one end thereof and to said available speed first motor at the other end.

5. Apparatus according to claim 4, wherein said means for spacedly mounting said disk over said turntable comprises a plurality of aerodynamic fins connecting said disk to said turntable and arrange to allow said flow of heated air to circulate therethrough.

6. Apparatus according to claim 5, which comprises a centrifugal fan disposed between said disk and said turntable, and means operatively connected to said centrifugal fan to provide a flow of air in said enclosure.

7. Apparatus according to claim 6, wherein said centrifugal fan is connected to a second motor by means of a shaft, said shaft extending through said sleeve.

8. Apparatus according to claim 7, which comprises a plurality of heating elements distributed along the outer wall of said cylindrical member on the path of said air flow.

9. Apparatus according to claim 8, wherein said centrifugal fan is constructed to direct said flow of air toward said circumferential wall, a first air diffuser is mounted in said enclosure on the path of said air flow to orient same substantially perpendicularly relative to said metal parts.

10. Apparatus according to claim 9, which comprises a second air diffuser mounted over said disk and constructed to redirect said air flow towards said centrifugal fan by passing through a central circular gap provided in said disk, thereby ensuring a continuous circulation thereof.

11. Apparatus according to claim 10, which comprises a vertical guide fixed to said second air diffuser and said circumferential wall and mounted to slide relative to the surface of said disk as the latter rotates, said guide defining a spiral path.

12. Apparatus according to claim 11 wherein said second air diffuser is mounted over said disk to cover said central circular gap, the opening in said cover being offset with respect to said central opening, said spiral path extending away from said central gap to reach said chute, said cover opening aligned with the start of said spiral path.

13. Apparatus according to claim 12, wherein said spiral path is shaped to enclose metal coils and to direct them towards said chute upon rotation of said disk.

* * * * *

UNITED STATES PATENT AND TRADEMARK OFFICE

CERTIFICATE OF CORRECTION

PATENT NO. : 5,556,593

DATED : September 17, 1996

INVENTOR(S) : Mario GRENIER

It is certified that error appears in the above-indentified patent and that said Letters Patent is hereby corrected as shown below:

Item 22, change "Filed: Dec. 14, 1995" to --Filed: Dec. 14, 1994--.

Signed and Sealed this

Twenty-fifth Day of March, 1997

*Attest:*

*Attesting Officer*

BRUCE LEHMAN

*Commissioner of Patents and Trademarks*